US006470871B2

(12) United States Patent
Casas-Salva

(10) Patent No.: US 6,470,871 B2
(45) Date of Patent: Oct. 29, 2002

(54) SMALL BULLET LOADING DEVICE REMOVABLY FITTED TO AN AIR GUN

(75) Inventor: Francisco Casas-Salva, Barcelona (ES)

(73) Assignee: Industrias, El Gamo, SA, Barcelona (ES)

( * ) Notice: Subject to any disclaimer, the term of this patent is extended or adjusted under 35 U.S.C. 154(b) by 12 days.

(21) Appl. No.: 09/815,298

(22) Filed: Mar. 23, 2001

(65) Prior Publication Data

US 2002/0059925 A1 May 23, 2002

(30) Foreign Application Priority Data

Mar. 24, 2000 (WO) ..... PCT/ES00/00108

(51) Int. Cl.[7] ..... F41B 11/02; F41B 11/20
(52) U.S. Cl. ..... 124/48; 124/67
(58) Field of Search ..... 124/48, 51.1, 66, 124/67, 74

(56) References Cited

U.S. PATENT DOCUMENTS 2,237,678 A * 4/1941 Lohr et al.
2,980,096 A * 4/1961 Merz
4,422,433 A * 12/1983 Milliman ..... 124/74
4,841,655 A * 6/1989 Ferri
4,848,307 A * 7/1989 Tsao ..... 124/67 X
4,986,251 A * 1/1991 Lilley ..... 124/67
5,186,156 A * 2/1993 Clayton ..... 124/67 X
5,522,374 A * 6/1996 Clayton ..... 124/67 X

* cited by examiner

*Primary Examiner*—John A. Ricci
(74) *Attorney, Agent, or Firm*—Jacobson Holman, PLLC

(57) ABSTRACT

A bullet loading device for an air gun comprises a removable loader (50) including a housing (1) wherein a revolving, small bullet carrying drum (2) is provided with axial through holes (3) uniformly distributed around the turning axis of the drum (2), each hole (3) being apt to house a bullet, the housing (1) being provided with an oscillating driving member (5) to revolve the drum (2) to sweep one angular interval, and a retainer to hold each of the axial holes (3) in alignment with a barrel of the gun, the gun integrating a slide (4) linearly guided on the housing (1) and kinematically linked to the oscillating driving member (5), which is provided with resilient driving catch (6) being apt to in turn engage stops of the drum (2) in order to thus revolve it in only one sense. The slide (4) carries out a first driving shift in a first sense being pushed by first protuberance (7) of an oscillating actuator (8), followed by a second shift in the opposite sense to a starting position being pushed by second protuberance (9) of the oscillating actuator (8).

15 Claims, 4 Drawing Sheets

SMALL BULLET LOADING DEVICE REMOVABLY FITTED TO AN AIR GUN

FIELD OF THE INVENTION

The present invention concerns a small bullet loading device removably fitted to an air gun provided with a compression piston actuated by a mail spring being tensioned by a lever or by the very gun barrel being provided in a tiltable arrangement by way of lever, said device comprising a removable, multishot small bullet loader provided with a revolver type drum and a slide mechanism designed to revolve said drum in concurrence with each main spring tensioning operation, in such a way that a small bullet is thus arranged in alignment with the gun by, said slide mechanism being actuated by an oscillating actuator cooperating with said lever or tiltable barrel.

BACKGROUND OF THE INVENTION

Air guns of the prior art are known which are provided with loading devices of the type comprising a removable loader being apt to house a certain number of small bullets, and means cooperating with the gun's main spring tensioner to position a small bullet in alignment with the gun barrel. An example of said loading devices is that adopted by the rifle sold under the trade name Gold Star Air Rifle, model PREFIX GT & GS, produced by the Firm BSA, wherein said removable loader includes a housing in whose inside a revolving, small bullet drum is mounted, said drum having holes having been provided to house the small bullets, these latter being introduced through an orifice of a cover of said housing. During the loader filling up operation it is necessary to successively revolve said drum in order to bring a next following empty hole to a position facing said orifice, said revolving motion bringing about a progressive tensioning of a torsion spring The loader is besides provided with retaining means designed to in turn hold each of said holes in alignment with the gun barrel. The gun is provided with a mechanism cooperating with a main spring tensioning lever momentarily releasing said drum retaining means, said torsion spring thereby pushing the drum thus causing it to sweep a certain angle to thus align the next following small bullet with the gun barrel. A compressed-air transfer tube delivers said small bullet from the loader to a chamber.

A drawback presented by this device of the BSA rifle lies in the fact that the loader filling up operation is a bothersome and annoying task since it requires to successively tension said torsion spring while at the same time bringing the next following empty hole of the drum to a position facing said orifice provided in the loader housing cover. In addition to this, the accuracy with which the small bullet is positioned by said loader is not enough to allow to shoot it, it being hence necessary to as has been mentioned previously deliver the small bullet to said chamber by means of said air transfer tube having been especially provided for such a purpose.

SUMMARY OF THE INVENTION

The object of the present invention is to provide a small bullet loading device being designed to be fitted to an air gun, being of a simple and reliable operation, being provided with a multishot loader that can be filled in an easy and convenient way, allowing to accurately position the small bullet in a robust drum also acting by way of chamber, and being actuated by the very mechanism being provided to tension the main spring actuating the air compressing piston of the gun.

This object is attained by means of the small bullet loading device provided to be fitted to an air gun as per the present invention, said device providing a removable, multishot loader including a housing being fitted in its inside with a revolving, small bullet carrying drum being provided with a plurality of axial holes distributed at uniform angular intervals around the turning axis of said drum, each hole being apt to house a small bullet. Said housing is provided with an actuating mechanism designed to in turn revolve said drum thereby causing it to sweep one of said angular intervals in one only direction, and with retention means designed to in turn hold each of said axial holes in alignment with the barrel of said gun. Said actuating mechanism comprises a slide being linearly guided on said housing and kinematically linked to an oscillating driving member provided with a resilient driving catch being apt to in turn engage the outlets of said holes of the drum in order to thus revolve it in one only sense. The gun is provided with an oscillating actuator cooperating with a lever provided to tension on the main spring actuating the air compressing piston, said lever advantageously being formed by the very tiltable barrel of the gun. Said oscillating actuator is preferably fitted to the gun by means of a pinjoint being coaxial with the turning axis of said tiltable barrel. When during a main spring tensioning operation the barrel is being tilted in a position proximate to the end of stroke for the tensioning of said spring a first area of the bottom face of the supporting body of said barrel interacts with a first stop of the oscillating actuator thus causing an oscillation of this later by means of which the first protuberance of the oscillating actuator pushes the slide at a first end thus bringing about a first shift causing said driving member to turn thus in its turn revolving the drum thus causing it to sweep one of said angular intervals by means of said resilient catch engaging the outlet of one of the holes of said drum. When the barrel is again brought to a shooting position said barrel body interacts with a second stop of the oscillating actuator thus causing an oscillation of this tatter in the opposite sense, by means of said oscillation a second protuberance then pushing the slide at a second opposite end of this latter thus bringing about a second shift serving to regain a sting position thus tuning the driving member in the opposite sense the resilient catch being now nevertheless deformed and retracted into a cavity of said driving member thus allowing the drum to remain in its position without turning backwards thanks to being locked, by retaining means formed by a ball being housed in a hole of the housing and spring-loaded by a spring held in said hole by a plug, said ball in turn snap-fitting into and thereby engaging longitudinal grooves that have been arranged in a cylindrical exterior surface of said drum and whose number is the same as that of said holes, said grooves having been equally distributed at said uniform angular intervals.

In order to facilitate the insertion, positioning and locking of the loader of the gun, as well as its removal, at opposite lateral ends of the housing the loader incorporates spring-loaded pushes hang been integrally formed with retractable, wedge-shaped catches being apt to snap-fit into inner recesses formed in a pocket provided in a mount of the gun. In this way, in order to install the loader it is only necessary to press it into said pocket all the way down till said wedge-shaped catches snap-fit into said recesses thereby becoming engaged in them. All that is needed in order to remove the loader is to release said catches by manually actuating on said pushes.

The position of the loader in the pocket is such that one of said holes of the drum is aligned with the barrel in the shooting position, as well as with a compressed-air passage, and in addition to this said first end of the slide is positioned in the path of said first protuberance of the oscillating actuator, and said second end of the slide is positioned in the path of said second protuberance of the oscillating actuator.

BRIEF DESCRIPTION OF THE DRAWINGS

These and other characteristics win be best appreciated in the light of the following detailed description referring to the enclosed drags wherein.

DETAILED DESCRIPTION OF A PREFERRED EXEMPLARY EMBODIMENT

Figure 1:
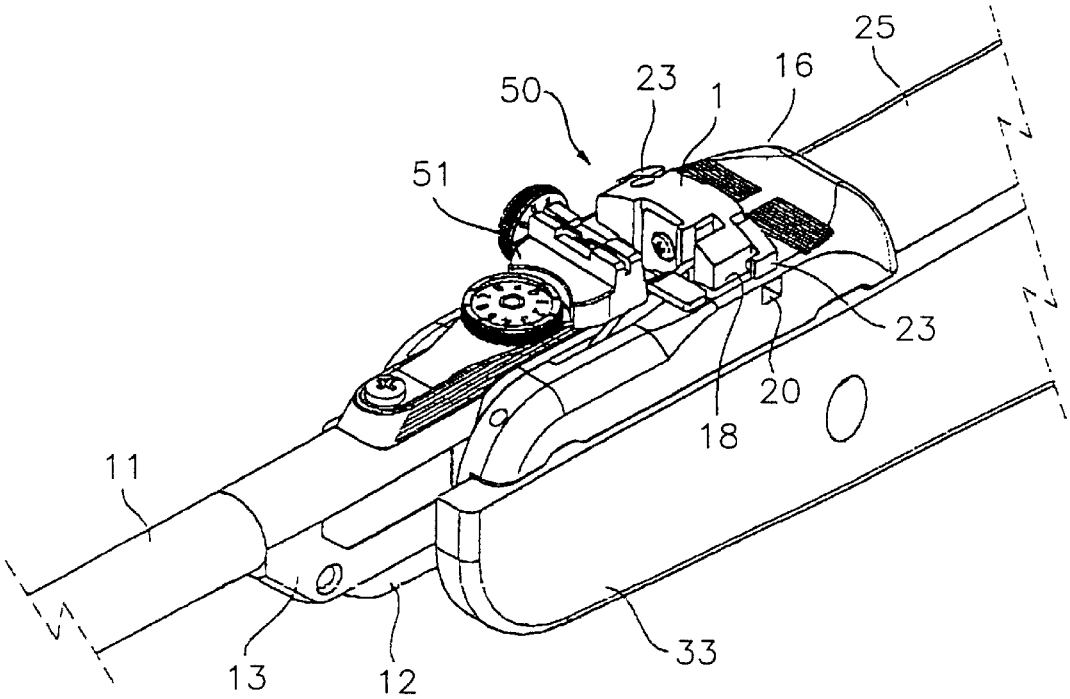
FIG. 1 is a partial, perspective view of an air gun with the small bullet loading device of the present invention.

Firstly referring to FIG. 1, this latter shows an air gun incorporating the small bullet loading device of the present invention. The gun in question is of the type comprising a compression chamber 25 being fitted in its inside with a piston being actuated by a main spring (these two latter members not having been shown), said spring being manually tensioned by a user of the gun by means of moving a tiltable barrel 11 being thus used by way of lever, said barrel 11 comprising a body 13 connected to a tensioning link 12 provided to tension said spring.

It is to be pointed out that although the figures illustrate the device of the invention having been implemented in a tiltable barrel gun said device could in its essential aspects be for example equally adapted to a gun of the fixed barrel type having a piston spring tensioning lever being independent from said barrel, for such a purpose providing modifications for the assembly of the loader as would be apparent to a person skilled in the art.

Still referring to FIG. 1, on one end of said compression chamber 25 and on the butt 33 of the gun and surrounding a sight holder 51 a mount 16 has been provided which incorporates a more or less prismatic pocket 18 being apt to house a removable, multishot small bullet loader 50 comprising a housing 1 being at opposite lateral ends provided with spring-loaded pushes 23 having been integrally formed with retractable, wedge-shaped catches 19 (see also FIGS. 2 through 4, 6 and 7) being apt to snap-fit into inner recesses 20 of said pocket 18 thereby becoming engaged in theme in such a way that in order to install the loader in the gun it is only necessary to press it into said pocket 18 all the way down till said wedge-shaped catches 19 snapfit into said recesses 20 thereby becoming engaged in them. All that is needed in order to remove the loader is to release said catches 29 by manually aching on said pushes 23 while pulling loader 50 outwards.

Figure 2:
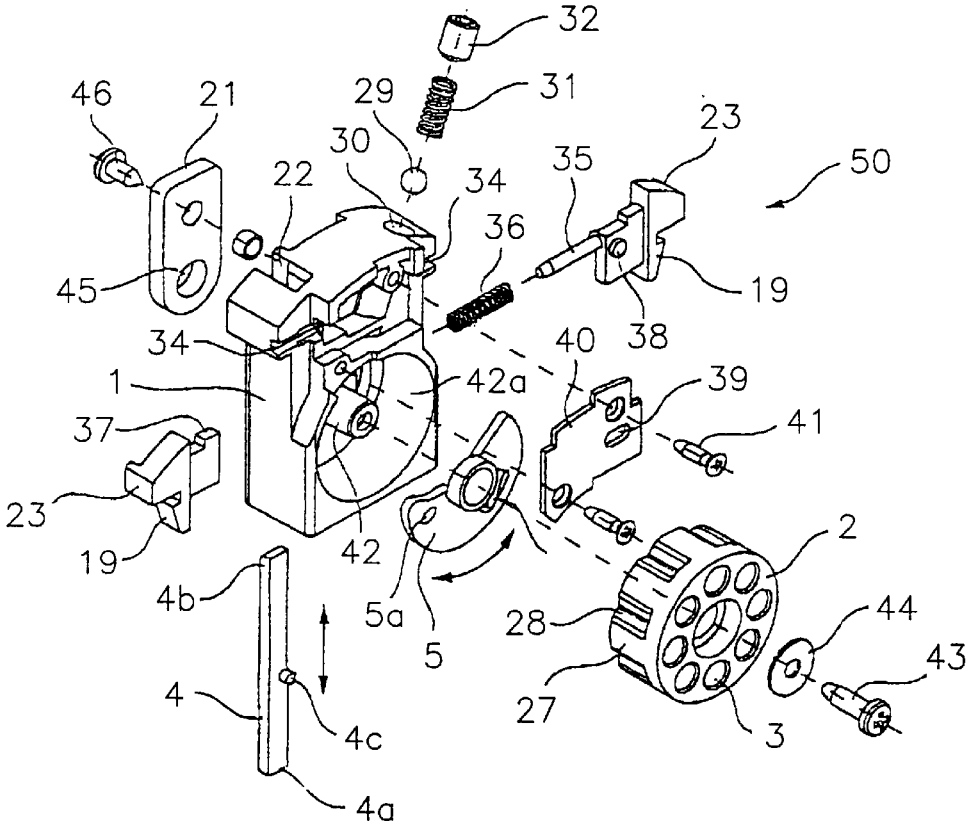
FIG. 2 is a perspective, exploded view showing the members integrating the loader of the device of FIG. 1.
Figure 3:
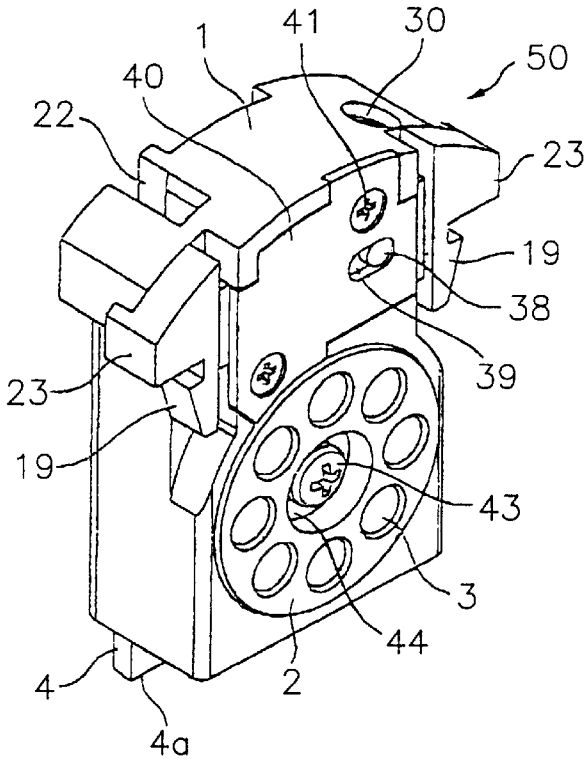
FIG. 3 is a view of the loader of FIG. 2 having been completely assembled.
Figure 4:
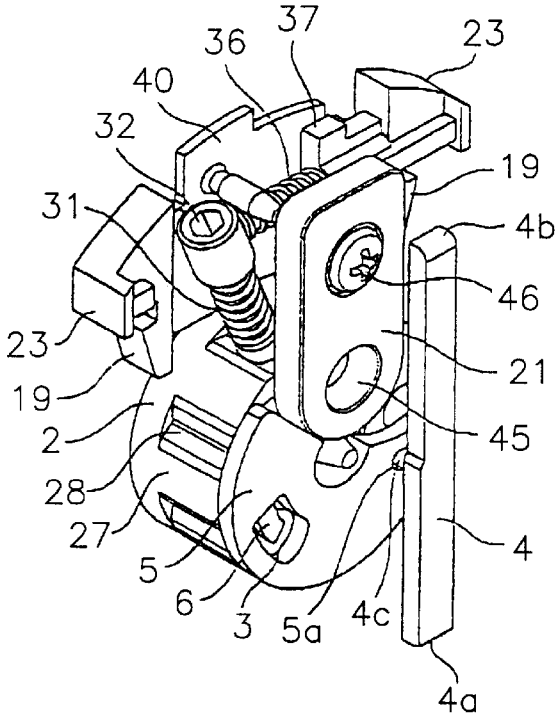
FIG. 4 is a perspective view taken from an opposite angle of the loader of FIG. 3 and without housing in order to allow to appreciate the interrelationship between its integrating members.

Referring now to FIGS. 2 through 4 housing 1 has transversal guides 34 for said pushes 23, one of these latter incorporating a stop 37 whereas the other one incorporates a supporting shaft 35 provided to support a spring 36 bringing about the spring-loaded arrangement of said pushes, and a stub 38 being apt to be shifted in a guided arrangement inside an oblong hole 39 of a cover 40 being secured to the housing by screws 41.

A revolving, small bullet carrying drum 2 is housed inside housing 1 and is provided with a plurality of Vial through holes 3 being distributed at uniform angular intervals around the axis of said drum 2, each hole 3 being provided to house a small bullet. Drum 2 does besides comprise a cylindrical exterior surface 27 having longitudinal grooves 28 whose number is the same as that of said holes 3, said grooves being equally distributed at said uniform angular intervals, a ball 29 being housed in a hole 30 of housing 1 and being spring-loaded by a spring 31 being held in said hole by a plug 32, said ball in turn snap-fitting into and thereby engaging said grooves 28 when drum 2 is revolved, said ball thus forming retention means provided to in turn maintain each of the axial holes 3 in alignment with said barrel 11 of said gun. Drum 2 revolves on a spigot 42 of the housing and is retained on it by a screw 43 and a washer 44.

An oscillating driving member 5 is superimposed on an end face of said drum 2 and is pivotally mounted in a coaxial arrangement with respect to the turning axis of said drum, i.e. on said spigot 42. Said driving member 5 is provided with a resilient driving catch 6 being apt to in tu and in an abutting arrangement engage each outlet of said holes 3 of drum 2. Loader 50 does besides comprise a slide 4 being superimposed on said oscillating driving member 5 and in a guided arrangement linearly sliding in a R on along a secant to said drum 2, said slide 4 having a protruding stub **4*c* being fitted into an oblong hole 5*a* of the oscillating driving member 5 thus forming a kinematic linkage between said slide 4 and oscillating driving member 5, in such a way that a first shift of slide 4 in a first sense causes oscillating driving member 5 to turn thus revolving drum 2 thereby causing it to sweep one of said angular intervals by virtue of the engagement of the resilient catch 6 in the outlet of a hole 3, and a second shift of slide 4 in the opposite sense causes driving member 5 to row a starting position without this time driving drum 2 due to the deformation of resilient catch 6, said drum being held in position by said ball 29 engaging one of said grooves 28 Slide 4 has a first end 4*a* projecting from the bottom of housing 1 (see FIG. 3), and a second end 4*b* being accessible inside a slot 22 of housing 1**.

Loader 50 does finally include a resilient sealing member 21 being provided with a passage 45 and secured to housing 1 by means of a screw 46, said resilient sealing member being designed to seal the juxtaposition between the back end of said body 13 of barrel 11 in shooting position and a front ice of drum 2, and the gun incorporates a resilient seal 24 (see FIG. 5) between a stopper **25*a* of said compression chamber 25 of the piston and a back face of drum 2**.

Figure 5:
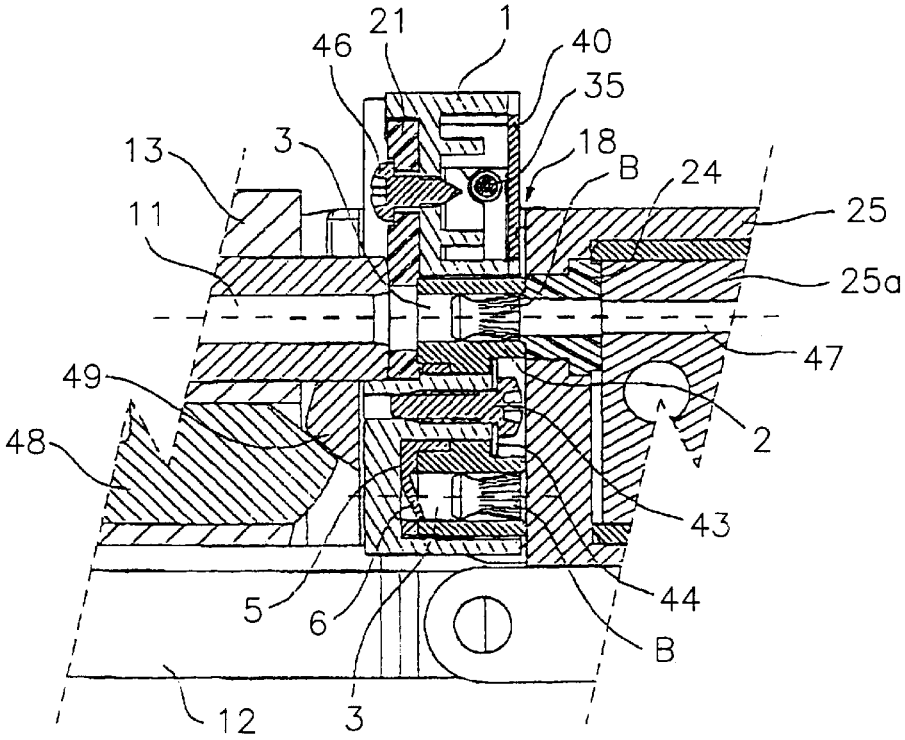
FIG. 5 is a partial view showing the assembly of FIG. 1 in a longitudinal section along a plane containing the axis of the gun barrel.
Figure 6:
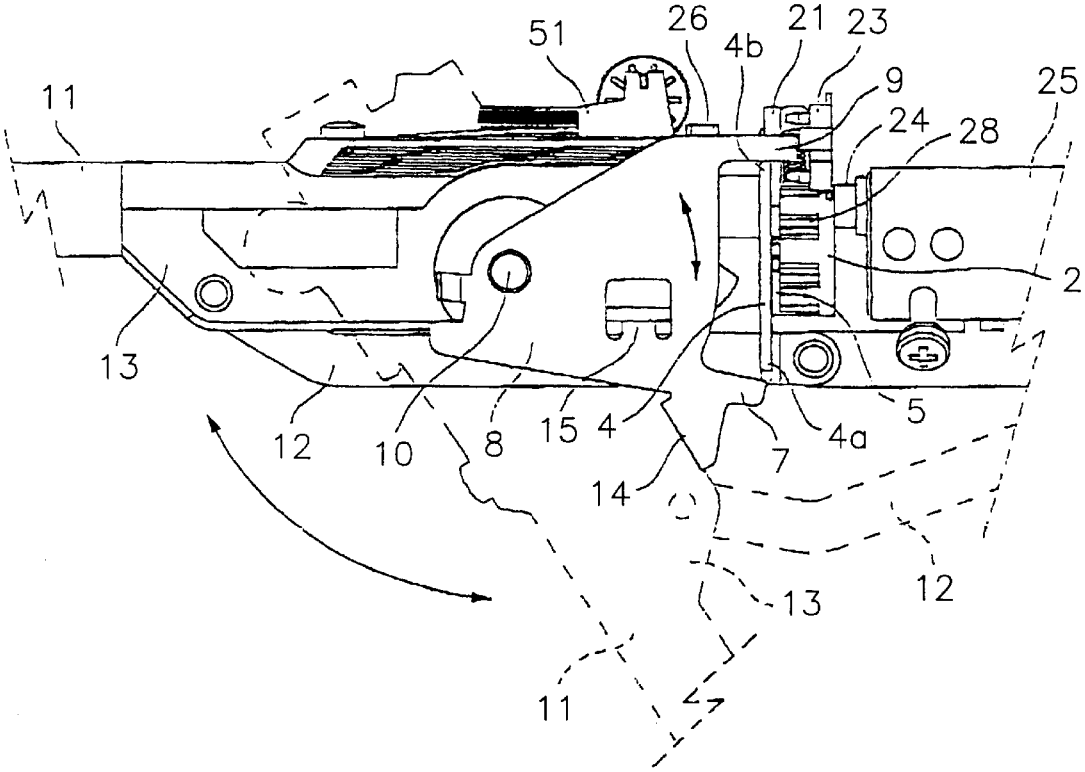
FIG. 6 is a partial side elevation showing the gun of FIG. 1 without the butt and the mount and with the loader of FIG. 3 but without this latter's housing in order to provide a better understanding of the operation of the assembly.
Figure 7:
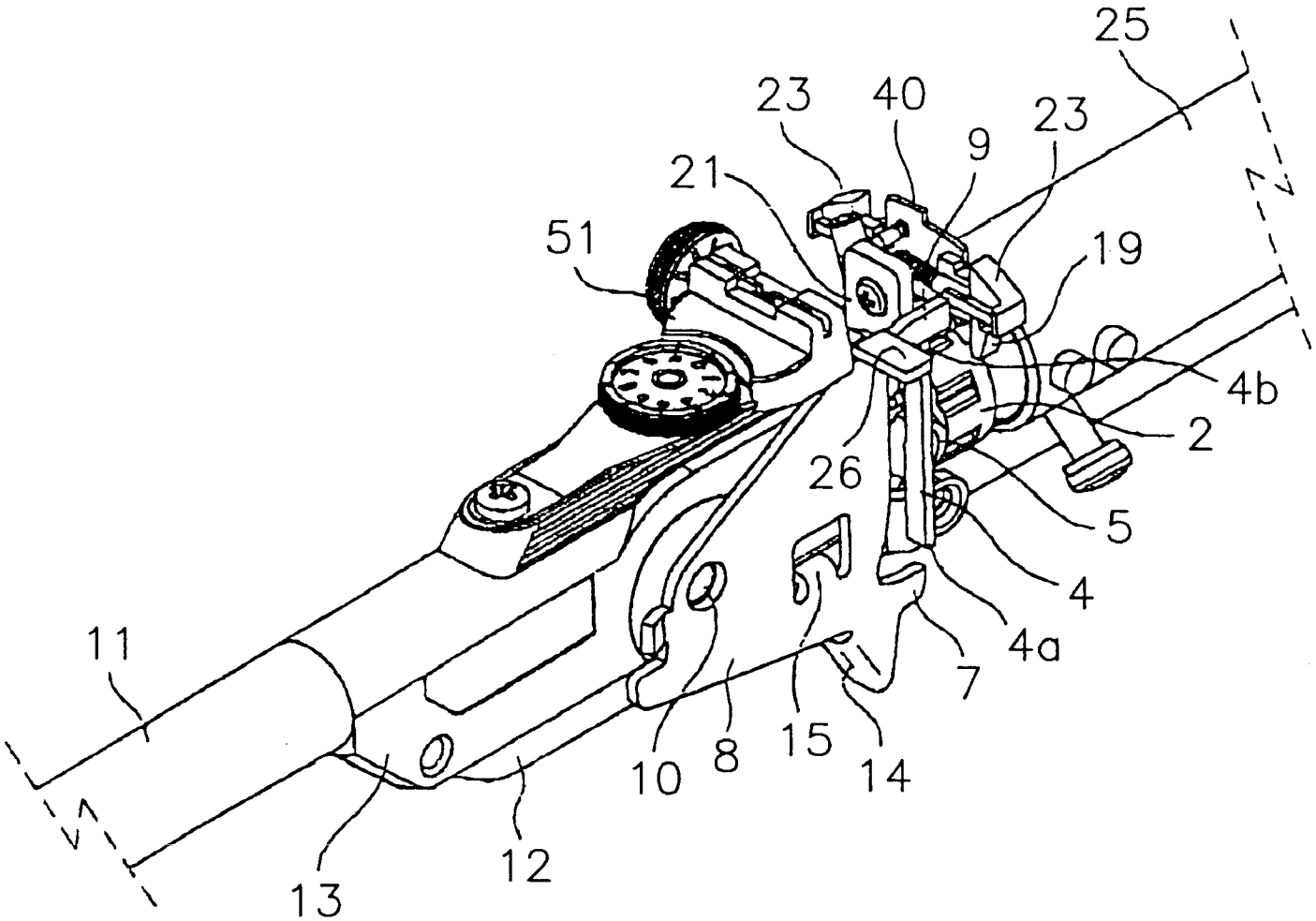
FIG. 7 is a partial, perspective view of the gun of FIG. 1 without the butt and mount and with the loader of FIG. 3 without its housing.

FIG. 5 shows in a longitudinal section the loader of FIGS. 2 through 5 having been installed in its operative position in the gun of FIG. 1, i.e. with loader 50 being housed in said pocket 18 of mount 16 and with the retractable, wedge-shaped catches 19 being locked in said inner recesses 20 (not visible in sad FIG. 5). In this position loader 50 is arranged in such a way that one of said holes 3 of drum 2 is aligned with barrel 11 in shooting position, said resilient sealing member 21 being pressed by the back end of barrel 11, said one of said holes being also aligned with an air passage 47 of said stopper 25*a* of compression chamber 25, this latter pressing said resilient seal 24. With this arrangement a small bullet B placed in said hole 3 aligned with barrel 11 and with said air passage 47 is ready to be shot, said hole 3 of drum 2 acting by way of chamber. Body 13 of tiltable barrel 11 incorporates a spring-loaded latch 48 abutting a stop 49 in order to thus maintain tiltable barrel 11 in said shooting position, Referring now to FIGS. 6 and 7, an oscillating actuator 8 is fitted to the gun by means of a pin-joint 10 being coaxial with the turning axis of tiltable barrel 11. Said oscillating actuator comprises first and second protuberances 7, 9 defining a fork-like configuration, slide 4 of loader 50 being arranged between said protuberances, said oscillating acuator also comprises first and second stops 14, 15 whose fiction will be explained hereinafter.

When said barrel 11 is being tilted in a position proximate to the end of stroke for the tensioning of said main spring (the position being shown with dash lines in FIG. 6) a first area of the bottom face of barrel body 13 interacts with said first stop 14 of oscillating actuator 8 thus causing an oscillation of this latter by means of which said first protuberance 7 pushes the At end 4*a* of slide 4 thus bringing about said first driving shift and when said barrel is again brought to a shooting position (the position being shown with solid lines in FIG. 6) said barrel body 13 interacts with said second stop 15 of oscillating actuator 8 thus causing an oscillation of this latter in the opposite sense, by means of said oscillation said second protuberance 9 then pushing the second, opposite end 4*b* of slide 4 thus bringing about said second shift serving to regain a starting position.

Oscillating actuator 8 is a spring-loaded member thus tending to maintain its first protuberance 9 applied on the first end 4*a* of slide 4, this preventing the uncontrolled Notions of said actuator when barrel 11 is partially tilted. Nevertheless, in order to facilitate the insertion/removal of loader 50 into/from pocket 18, said operation having to be carried out with the barrel m said partially tilted position, oscillating actuator 8 has an appendage 26 being apt to be manually pushed by said user of the gun in order to change is the actuator's position to thus free the way for loader 50 to pass.

A characteristic of said loader 50 of the present invention lies in the act that at least said housing 1, said drum 2, said slide 4, said oscillating driving member 5 and said pushes 23 are obtained by injection moulding of a plastics material such as an acetal resin conferring them a high strength with a light weight and relatively low forming costs.

What is claimed is:

1. A small bullet loading device removably fitted to an air gun, said device being of the type comprising a removable loader (50) including a housing (1) being fitted in its inside with a revolving, small bullet carrying drum (2) being provided with a plurality of axial through holes (3) distributed at uniform angular intervals around the turning axis of said drum (2), each hole (3) being apt to house a small bullet, said housing (1) being provided with actuating means designed to in turn revolve said drum (2) thereby causing it to sweep one of said angular intervals in one only direction, and with retention means designed to in turn hold each of said axial holes (3) in alignment with a barrel of said gun, said gun integrating means to actuate said actuating means; characterized in that said actuating means comprise a slide (4) being linearly guided on said housing (1) and kinematically linked to an oscillating driving member (5) provided with a resilient driving catch (6) being apt to in turn engage stops of the drum (2) in order to thus revolve it in one only sense, said slide (4) in each turn carrying out a first driving shift in a first sense because of being pushed by a first protuberance (7) of an oscillating acuator (8) forming said actuating means, said first driving shift being then followed by a second shift in the opposite sense serving to regain a starting position, said second shift being brought about by the fact that said slide is on this occasion pushed by a second protuberance (9) of said oscillating actuator (8), said actuator being fitted to said gun by means of a pin-joint (10) and cooperating with a lever being manually actuated by a user of said gun, said lever thus shifting said actuator (8) thereby bringing about its oscillation in both senses.

2. A loading device as per claim 1, characterized in that said lever being provided to be manually actuated by a user is a tiltable barrel (11) of said gun, said barrel being connected to a tensioning link (12) provided to tension a spring designed to actuate. an air compressing piston.

3. A loading device as per claim 2, characterized in that when a body (13) supporting said barrel (11) is being tilted in a position proximate to the end of stroke for the tensioning of said spring said supporting body interacts at a first area of its bottom face with a first stop (14) of said oscillating actuator (8) thus causing an oscillation of this latter by means of which said first protuberance (7) pushes the slide (4) at a first end (4*a*) thus bringing about said first driving shift, and in that when said barrel regains a shooting position said body (13) of barrel (11) at a second area of its bottom face interacts with a second stop (15) of said oscillating actuator (8) thus causing an oscillation of this latter in the opposite sense, by means of said oscillation said second protuberance (9) then pushing the slide (4) at a second, opposite end (4*b*) thus bringing about said second shift serving to regain a starting position.

4. A loading device as per claim 3, characterized in that said pin-joint (10) of the oscillating actuator (8) is coaxial with the turning axis of said tiltable barrel (11).

5. A loading device as per claim 1, characterized in that said lever being provided to be manually actuated by a user is connected to a tensioning link provided to tension a spring designed to actuate an air compressing piston of said gun.

6. A loading device as per claim 1, characterized in that said drum (2) is housed in a cavity (42*a*) of the housing (1) and revolves on a spigot (42) and is retained thereon by retaining means such as a screw (43) and a washer (44).

7. A loading device as per claim 6, characterized in that said oscillating driving member (5) is superimposed on an end face of said drum (2) and is pivotally mounted on said spigot (42) in a coaxial arrangement with respect to the turning axis of said drum, said holes (3) of drum (2) forming said stops being engaged by said resilient driving catch (6).

8. A loading device as per claim 7, characterized in that said slide (4) is superimposed on said oscillating driving member (5) and in such an arrangement carries out a linearly sliding motion in a direction along a secant to said drum (2), and in that said slide (4) has a protruding stub (4*c*) being fitted into an oblong hole (5*a*) of the oscillating driving member (5) thus forming said kinematic linkage between said slide (4) and driving member (5).

9. A loading device as per claim 8, characterized in that said loader (50) includes a resilient sealing member (21) secured to the housing (1), said sealing member being designed to seal the juxtaposition between a back end of said body (13) of barrel (11) in shooting position and a front face of drum (2), and the gun incorporates a resilient seal (24)

between a stopper (25*a*) of a compression chamber (25) of the piston and a back face of drum (2).

10. A loading device as per claim 9, characterized in that said housing (1) integrates a slot (22) whose inside gives access to said second end (4*b*) of the slide (4), whereas said first end (4*a*) of this latter projects from the bottom of housing (1).

11. A loading device as per claim 10, characterized in that said loader (50) incorporates releasable locking means provided to lock it in the gun in an operating position such that one of said through holes (3) of drum (2) is aligned at one side with the barrel (11) in shooting position and at the other side with an air passage (47) of said topper (25*a*) of the compression chamber (25), said first end (4*a*) of the slide (4) being ituated in the path of said first protuberance (7) of the oscillating actuator (8), said slot (22) housing in its inside said second end (4*b*) being situated in the path of said second protuberance (9) of said oscillating actuator (8).

12. A loading device as per claim 11, characterized in that said oscillating actuator (8) is a spring-loaded member thus maintaining said first protuberance (7) applied on the first end (4*a*) of slide (4) when barrel (11) is partially tilted, said oscillating actuator (8) having an appendage (26) being apt to be manually pushed by said user of the gun in order to change the actuator's position to thus facilitate the. insertion/removal of the loader (50) into/from the pocket (18).

13. A loading device as per claim 1, characterized in that at opposite lateral ends of the housing (1) said loader (50) incorporates spring-loaded pushes (23) having been integrally formed with retractable, wedge-shaped catches (19) being apt to snap-fit into inner recesses (20) provided in a pocket (18) located in a mount (16) of the gun, this arrangement being designed to retain said loader (50) in an operating position inside said pocket (18), said loader being releasable by means of manually actuating on said pushes (23).

14. A loading device as per claim 1, characterized in that said drum (2) comprises a cylindrical exterior surface (27) having longitudinal grooves (28) whose number is the same as that of said holes (3), said grooves being equally distributed at said uniform angular intervals, a ball (29) being housed in a hole (30) of housing (1) and being spring-loaded by a spring (31) being held in said hole by a plug (32), said ball in turn snap-fitting into and thereby engaging said grooves (28) when drum (2) is revolved, said ball thus forming said retention means provided to in turn maintain each of the axial holes (3) in alignment with said barrel (11) of said gun.

15. A loading device as per claim 1, characterized in that at least said housing (1), said drum (2), said slide (4), said oscillating driving member (5) and said pushes (23) are obtained by injection moulding of a plastics material such as an acetal resin.

* * * * *